US008491288B2

(12) United States Patent
Lyons et al.

(10) Patent No.: US 8,491,288 B2
(45) Date of Patent: Jul. 23, 2013

(54) GEROLLER HYDRAULIC MOTOR WITH ANTI-COGGING STRUCTURE

(75) Inventors: Terry Lynn Lyons, Bluff City, TN (US); Maynard Wayne Marts, Jonesborough, TN (US); Michael L. Melton, Greeneville, TN (US); Ricky L. Kegley, Greeneville, TN (US); Jason Scot Richardson, Chuckey, TN (US); John M. Rector, Jonesborough, TN (US)

(73) Assignee: Parker Hannifin Corporation, Cleveland, OH (US)

( * ) Notice: Subject to any disclaimer, the term of this patent is extended or adjusted under 35 U.S.C. 154(b) by 886 days.

(21) Appl. No.: 12/576,298

(22) Filed: Oct. 9, 2009

(65) Prior Publication Data

US 2011/0085928 A1 Apr. 14, 2011

(51) Int. Cl.
*F03C 2/00* (2006.01)
*F03C 4/00* (2006.01)
*F04C 2/00* (2006.01)

(52) U.S. Cl.
USPC ..... 418/61.3; 418/72; 418/75; 418/132

(58) Field of Classification Search
USPC ..... 418/61.3, 171, 71, 72, 75–77, 131–133
See application file for complete search history.

(56) References Cited

U.S. PATENT DOCUMENTS 3,627,454 A * 12/1971 Goff et al. ..... 418/61.3
3,846,051 A * 11/1974 McDermott ..... 418/61.3
3,964,842 A 6/1976 White, Jr.
4,032,267 A 6/1977 Miller
4,087,215 A 5/1978 Miller
4,219,313 A 8/1980 Miller et al.
4,411,606 A 10/1983 Miller
4,563,136 A 1/1986 Gervais et al.
4,699,577 A 10/1987 Dlugokecki et al.
5,061,160 A 10/1991 Kinder et al.
5,062,776 A 11/1991 Dlugokecki
6,193,490 B1 * 2/2001 White ..... 418/61.3
6,257,853 B1 7/2001 White
6,699,024 B2 3/2004 Dong
6,793,472 B2 9/2004 Dong
2009/0317277 A1 * 12/2009 Daigre ..... 418/61.3

* cited by examiner

*Primary Examiner* — Theresa Trieu
(74) *Attorney, Agent, or Firm* — Renner, Otto, Boisselle & Sklar, LLP

(57) ABSTRACT

A hydraulic motor receives pressurized fluid from a source controlled by a human operator to convert the energy in the hydraulic fluid to a rotational output to propel a drive wheel of a machine. The hydraulic motor includes an end cover, a manifold, a drive assembly, a wear plate, a housing, and an output assembly. The drive assembly includes a rotor with external teeth and a stator with internal teeth formed by rollers having end faces. The pressurized fluid from the source flows through the manifold to the drive assembly and causes rotational and orbital movement of the rotor relative to the stator. The rotational movement of the rotor is transmitted to the drive wheel by the output assembly. A first set of anti-cogging passages and a second set of anti-cogging passages communicate fluid pressure to the end faces in timed relationship to reduce cogging or detenting of the rotational output of the motor.

24 Claims, 6 Drawing Sheets

GEROLLER HYDRAULIC MOTOR WITH ANTI-COGGING STRUCTURE

CROSS REFERENCE TO RELATED APPLICATIONS

None.

TECHNICAL FIELD

The present invention relates to low speed high torque geroller hydraulic motors. Geroller hydraulic motors are well known and include a gerotor drive assembly having mating internal and external gear sets in which at least some of the teeth of one of the gear sets are provided by rollers.

BACKGROUND OF THE INVENTION

Geroller hydraulic motors receive pressurized fluid as an input and provide high torque rotational movement as an output. The gear sets of the hydraulic motor drive assembly cooperatively define fluid chambers. The chambers expand when hydraulically connected to a source of pressurized fluid and contract when connected to a drain that returns the fluid to the source. The expansion and contraction of the fluid chambers causes the rotational movement.

These motors are relatively small and efficient, and the rotational output is widely used to move and control various types of equipment. In many of these uses, a human operator controls a source of pressurized fluid for the hydraulic motor. This controls the input to the hydraulic motor and, in turn, controls the rotational output (speed and torque) of the hydraulic motor.

Geroller hydraulic motors can exhibit cogging at relatively low speeds. Cogging is a jerking or detenting or variation in the rotational output speed of the hydraulic motor that (a) occurs during each complete (360 degree) rotation of the motor output, (b) at a frequency measured in cogs per revolution that is related to the number of teeth in the geroller gear set in the hydraulic motor drive assembly, and (c) is accompanied by measurable pressure variations in the input to the hydraulic motor. All geroller hydraulic motors may tend to exhibit some amount of cogging at low operating speeds as a gear in one of the gear sets rotates into mating alignment with a gear in the other gear set and hydraulic fluid passages connected to the fluid chambers are opened and closed. Cogging can result from dimensional tolerances in the hydraulic motor.

Even if a hydraulic motor exhibits cogging, the cogging may not be objectionable in some equipment in which the hydraulic motor is used under some operating conditions. For example, if a hydraulic motor is used to rotate brushes in an automatic car wash system, the brush may rotate at a relatively constant speed when the equipment is operated and precise control at low speeds during starting and stopping may not be needed. In this instance, cogging at low speeds might not be objectionable.

In certain operating conditions of other types of equipment in which geroller hydraulic motors are used, however, cogging can be objectionable. Objectionable means that an ordinary human operator of the equipment that is experienced in operating the equipment would (a) notice the cogging under specific operating conditions, and (b) prefer that the cogging be eliminated in order to improve performance of the hydraulic motor and of the equipment in which the hydraulic motor is used under those operating conditions.

As an example of an application for geroller hydraulic motors in which cogging at low speed can be objectionable, geroller hydraulic motors are frequently used in lawn equipment including lawn mowers to control the equipment's drive wheels. The drive wheels are rotated by the hydraulic motor to propel the vehicle. In that use, a variable displacement hydraulic pump can be used to provide the pressurized fluid input to control the geroller hydraulic motor. One pump and one hydraulic motor can be associated with each of the drive wheels of the equipment. The human operator can use control levers that separately control the output displacement of each of the variable displacement pumps, so that the rotational speed and rotational direction of each hydraulic motor, and the rotational speed and rotational direction of each drive wheel rotated by that motor, is controlled. Because each pump and motor associated with each drive wheel is separately controlled, the human operator can precisely control forward and reverse speed and turning of the equipment.

In many operating conditions for this type of equipment, the equipment is operated at or near maximum over the ground speed. In these operating conditions, the hydraulic motors are operated at or close to their maximum rotational speed as determined by the maximum hydraulic fluid displacement of the variable displacement hydraulic pump associated with each motor. Under these conditions, any cogging of the geroller hydraulic motors may not be objectionable. In other operating conditions, however, the hydraulic motors are used at low rotational speeds and at high fluid pressures. Low rotational speed of a geroller hydraulic motor means less than five revolutions per minute of the output shaft of the motor, and high pressure means greater than 1000 pounds per square inch fluid pressure at the inlet port of the motor. These operating conditions can include propelling the equipment up a sloped surface at relatively slow speed, such as propelling the equipment up a sloped lawn surface or up a ramp for loading the equipment into a trailer or a truck. Under these operating conditions, cogging of the hydraulic motors can be objectionable. Objectionable cogging can also occur in other types of equipment and in other types of hydraulic circuits that incorporate geroller hydraulic motors and in other conditions.

SUMMARY OF THE INVENTION

The present invention provides a geroller hydraulic motor in which an anti-cogging structure reduces cogging in at least one rotational direction in comparison with the same geroller hydraulic motor that does not incorporate the anti-cogging structure. The invention also provides a hydraulic circuit and equipment in which such circuit is incorporated to reduce cogging in at least one rotational direction. The invention also provides various ones of the features and structures described in the claims set out below, alone and in combination, which claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

An embodiment of the present invention is shown in FIGS. 1-8 and is described below.

Although the principles, embodiments and operation of the present invention are shown and described in detail herein, these drawings and this description are not to be construed as being limited to the particular illustrative forms disclosed. It will thus become apparent to those skilled in the art that various modifications of the embodiments herein can be made without departing from the spirit or scope of the invention.

Figure 1:
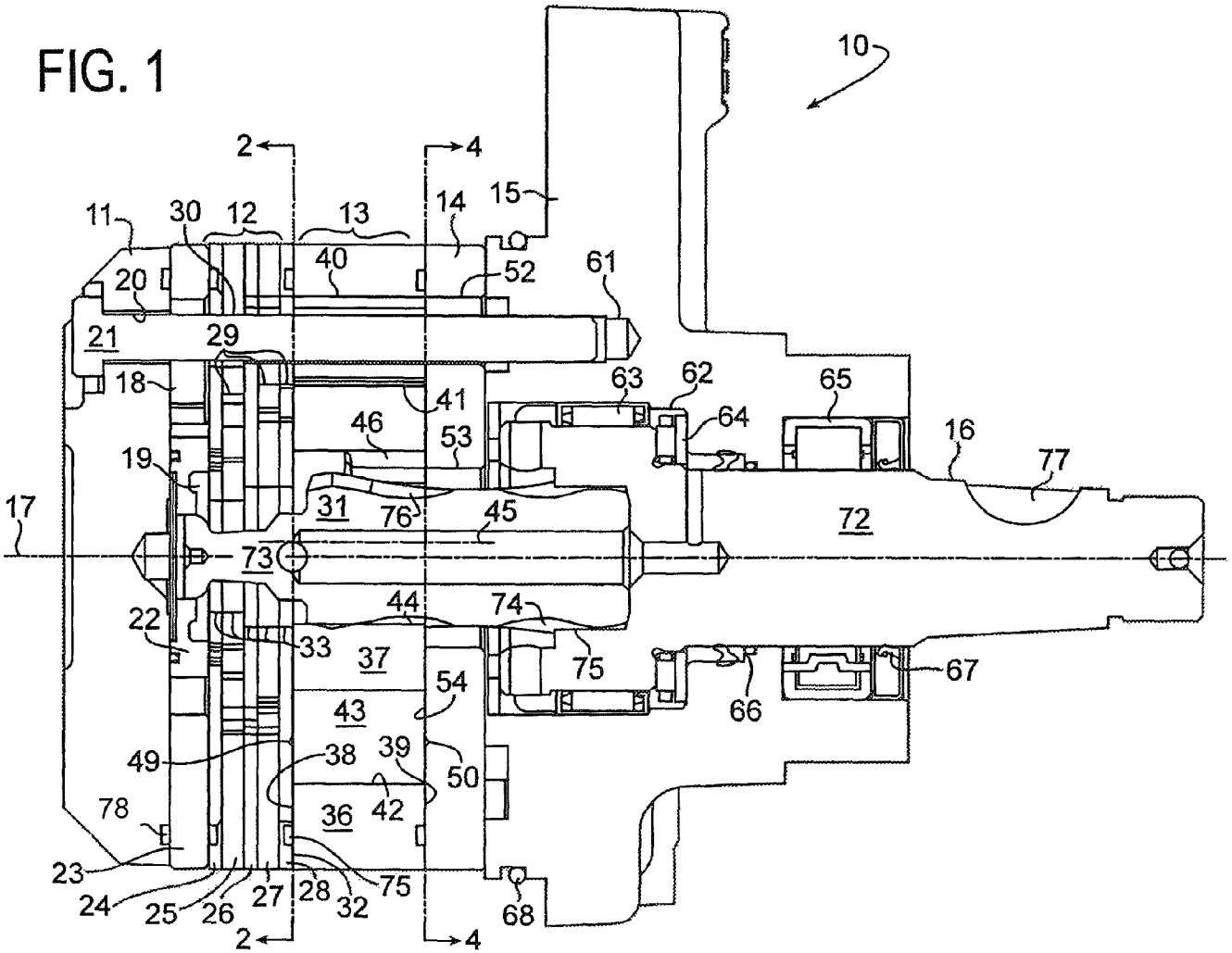
FIG. 1 is a longitudinal cross sectional side elevation view of a presently preferred embodiment of a geroller hydraulic motor incorporating the principles of this invention.

Referring now to FIG. 1 in greater detail, a geroller hydraulic motor 10 includes an end plate 11, a manifold 12, a drive assembly 13, a wear plate 14, a housing 15, an output assembly 16 and a longitudinal axis 17. As described further below, the members 11, 12, 13, 14, 15 and 16 are each generally cylindrical and are shown in FIG. 1 as being separate components. Alternatively, certain of these components can be integral with one another. Also, the hydraulic motor 10 can be a separate structure from other hydraulic components in a hydraulic circuit in which it is used, or it can be integral with and in a common housing with other components in a hydraulic circuit, or it can be bolted to such other components. In the presently preferred embodiment of the hydraulic motor 10, and as described below with reference to FIG. 8, the hydraulic motor 10 is bolted to a hydraulic pump 98 in a well known manner. When the hydraulic motor 10 and the hydraulic pump 98 are bolted together or in an integral housing and used to propel a vehicle as described further below with reference to FIG. 8, the motor and pump assembly is sometimes referred to as a unitized hydraulic transmission.

As also explained in further detail below, the hydraulic motor 10 is driven in a rotational direction around its longitudinal axis 17 by pressurized fluid from the hydraulic pump in a forward direction or in a reverse direction. In the embodiment shown herein, the hydraulic motor 10 is arranged so that its forward direction is counterclockwise when viewed in a longitudinal direction from its right end in FIG. 1 looking toward its left end. When the terms counterclockwise and clockwise are used herein, it is with reference to viewing the motor 10 in this direction. The reverse direction of the motor 10 is clockwise. During most of the operation of the motor 10 it is operated in the forward direction, and the reverse direction is typically used less frequently. The operation of the hydraulic motor 10 is described below in the forward direction, and the reverse rotational direction of the motor 10 can be achieved by reversing the flow of hydraulic fluid through the motor 10, as is well known.

The end plate 11 of the hydraulic motor 10 includes a plurality of inlet plate bolt holes 20, only one of which is shown in FIG. 1. Each bolt hole 20 receives a threaded bolt 21. The bolts 21 secure the inlet plate 11, the manifold 12, the drive assembly 13, the wear plate 14, and the housing 15 together in a well know manner. In the preferred embodiment, the end plate 11 is preferably machined from a steel forging, but alternatively it may be cast or of any other suitable construction in a well known manner.

Figure 2:
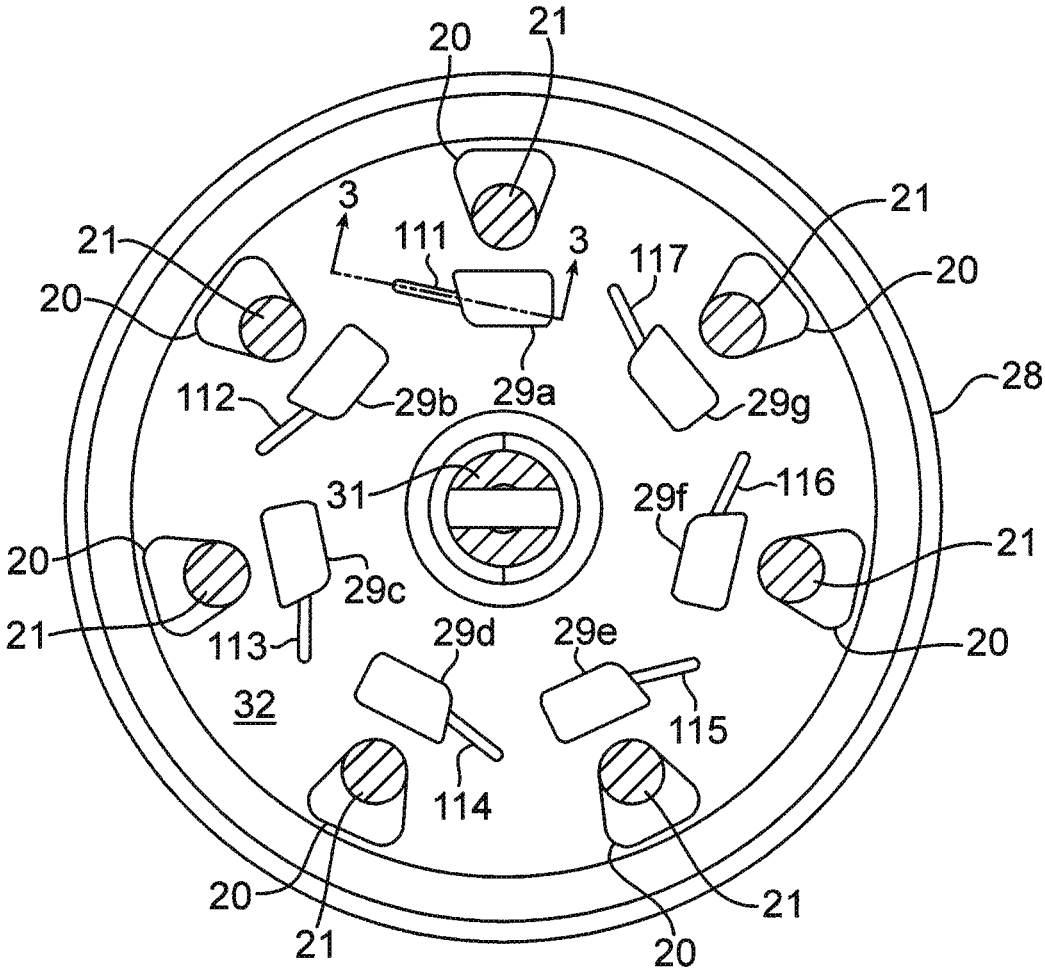
FIG. 2 is lateral cross sectional view taken along reference view line 2-2 of FIG. 1, in a plane perpendicular to the longitudinal axis of FIG. 1.
Figure 3:
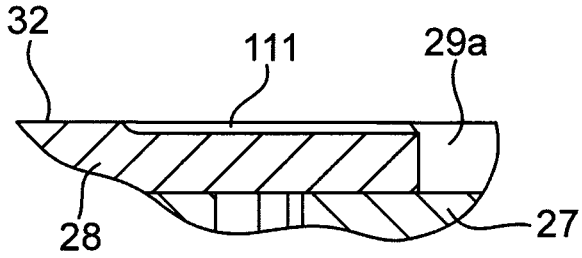
FIG. 3 is a partial cross sectional view taken along reference view line 3-3 of FIG. 2, in a plane parallel to the longitudinal axis of FIG. 1.

As best shown in FIGS. 1 and 2, the manifold 12 includes a generally flat commutator plate 22 and generally flat stationary plates 23-28. The commutator plate 22 separates an inlet chamber 18 from an outlet chamber 19. The stationary plates 23-28 each include a plurality of fluid flow passages 29 and 33 that extend through the plates 23-28. The fluid flow passages 29 terminate at a lateral or radial end face 32 of the stator plate 28 at passage openings **29*a*-29*g*, as further described below. The plates 23-28 each also include seven bolt holes 30 for receiving the bolts 21** and for providing a fluid flow path.

The stationary plates 23-28 of the manifold 12 are steel plates that are brazed together in a well known manner. The commutator plate 22 is driven by a drive link 31 of the output assembly 16 as further described below. The commutator plate 22 is moved by the drive link 31 in an orbital path relative to the stationary plates 23-28 in a well known manner to open and close fluid communication between the inlet chamber 18 and the passages 29 and also between the outlet chamber 19 and the passages 29. The passages 29 of the manifold 12 in turn supply higher pressure pressurized hydraulic fluid from the inlet chamber 18 to, and receive lower pressure return hydraulic fluid from, the drive assembly 13 to cause rotation of the hydraulic motor 10 in the forward direction as also further described below. The longitudinally facing planar lateral end face 32 of the manifold plate 28 of the manifold 12 is disposed in a plane perpendicular to the axis 17.

The drive assembly 13 includes a stator 36 and a rotor 37. The stator 36 and the rotor 37 each includes a planar lateral end face 38 that is disposed in a plane parallel to the end face 32 and that engages the end face 32. The stator 36 and rotor 37 each also include another planar lateral end face 39 that is parallel to the end face 38 and that engages the wear plate 14. The stator 36 includes seven bolt holes 40, only one of which is shown in FIG. 1, for receiving the bolts 21 and for providing fluid flow passages. The stator 36 also includes a longitudinally extending central opening 41 along the longitudinal axis 17. The central opening 41 is generally circular in lateral cross section. As illustrated schematically in FIG. 6 and described further below, the opening 41 provides seven semi-circular longitudinally extending pockets 42, each of which receives a longitudinally extending cylindrical roller 43 which is free to rotate in its respective pocket. The rollers 43 each include a cylindrical surface 48 and end faces 49 and 50 as shown in FIG. 1. The seven rollers 43 provide seven internal gear teeth within the central opening 41, and the seven internal gear teeth 43 provide an internal gear set for the drive assembly 13.

Figure 6:
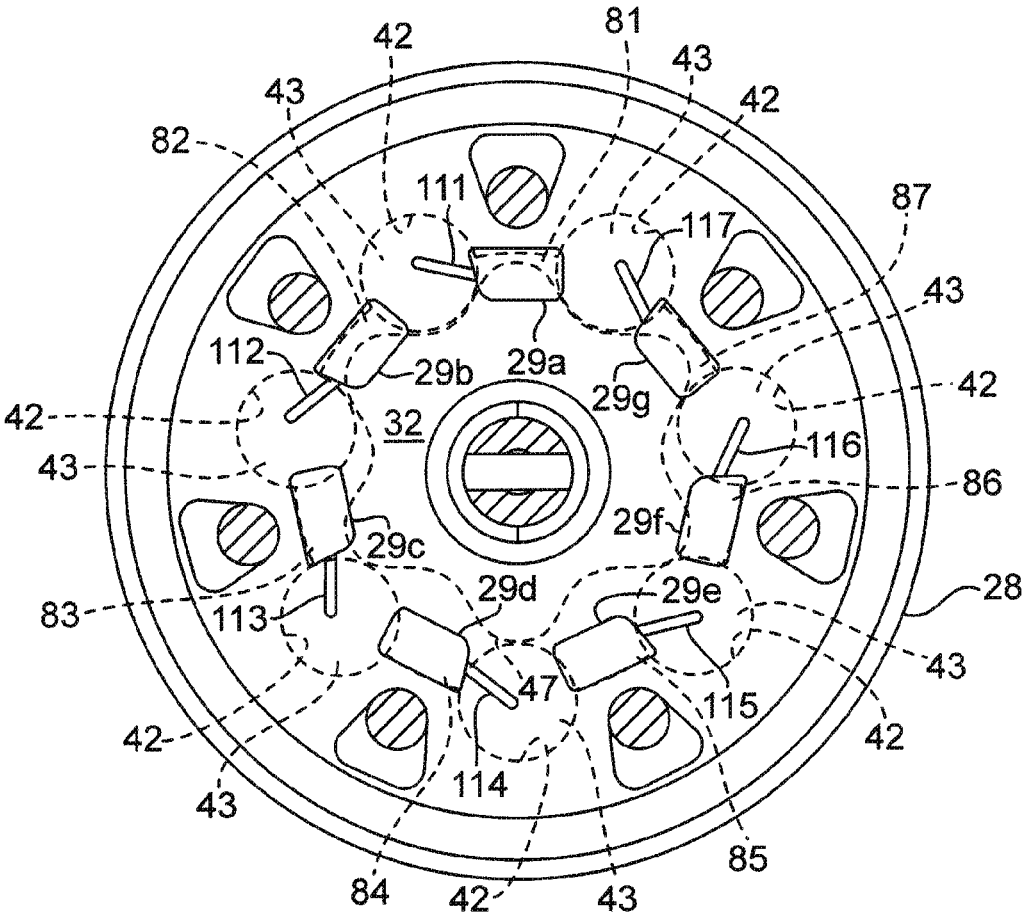
FIG. 6 is a view identical to FIG. 2, but with the addition of a dotted line outline of the stator and rotor to illustrate the alignment and relative positions of the stator, rotor, fluid chambers, and first set of anti-cogging passages in the hydraulic motor of FIG. 1.

Referring to FIGS. 1 and 6, the rotor 37 includes a longitudinally extending central opening 44 and a longitudinal axis 45 that is parallel to and radially spaced from the longitudinal axis 17 of the stator 36. The surface of the central opening 44 is generally circular in lateral cross section and has a plurality of splines 46 for mating with corresponding external splines located on the drive link 31 and further described below. The exterior surface of the rotor 37 defines a plurality of external teeth 47. The number of external teeth 47 on the rotor 37 is one less than the number of internal teeth 43 on the stator 36. The external teeth 47 provide an external gear set that meshes with the internal gear teeth 43 as the rotor 37 rotates and orbits relative to the stator 36. In the forward direction of the hydraulic motor 10, the rotor 37 and the drive link 31 both rotate in the counterclockwise direction and the rotor 37 and the commutator plate 22 both orbit in the clockwise direction as more fully described below. The stator 36 and rotor 37 are of machined steel.

Figure 4:
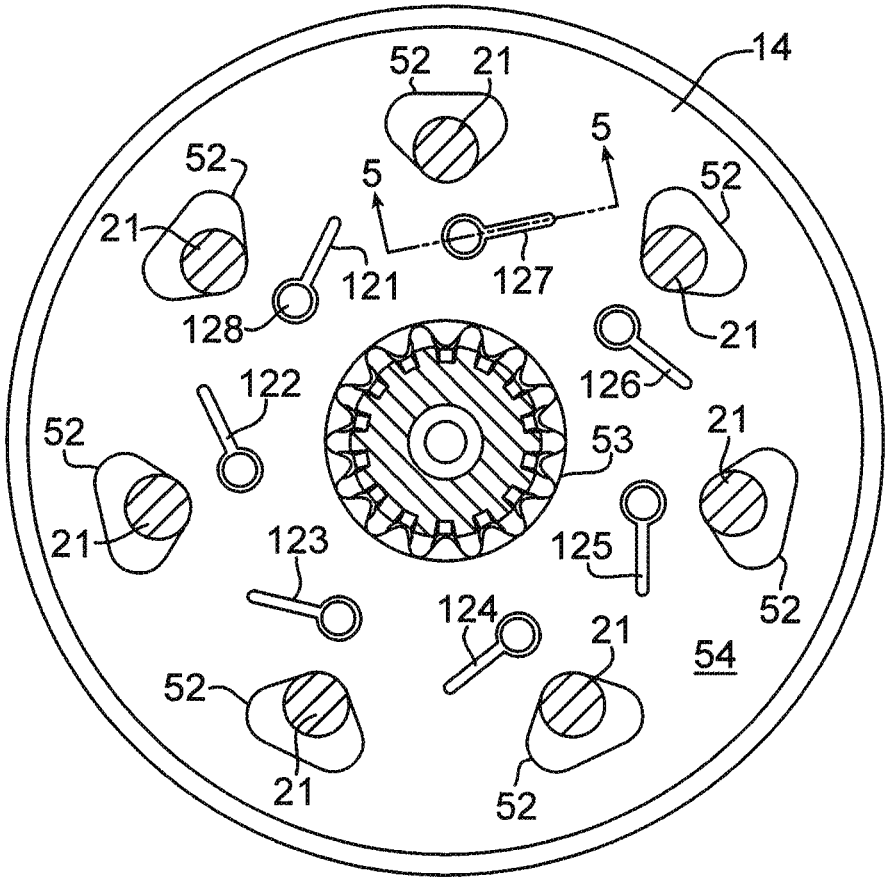
FIG. 4 is lateral cross sectional view taken along reference view line 4-4 of FIG. 1, in a plane perpendicular to the longitudinal axis of FIG. 1.
Figure 5:
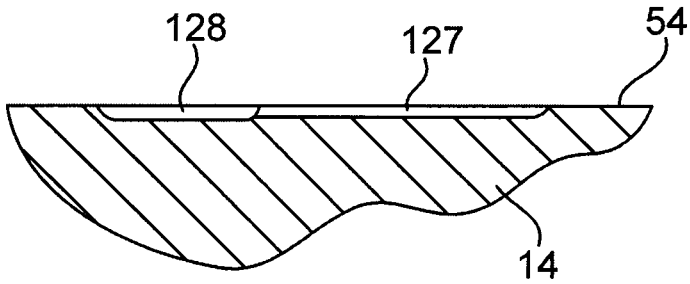
FIG. 5 is a partial cross sectional view taken along reference view line 5-5 of FIG. 4, in a plane parallel to the longitudinal axis of FIG. 1.

As best shown in FIGS. 1 and 4, the wear plate 14 includes bolt holes 52 for receiving the bolts 21 and for providing fluid flow passages. The wear plate 14 includes a longitudinally extending central opening 53 along the longitudinal axis 17. The wear plate 14 also includes a planar lateral end face 54 that is parallel to and that engages the end faces 39 of the stator 36 and rotor 37. The wear plate 14 is also of machined steel.

Referring to FIG. 1, the housing 15 includes blind threaded bolt holes 61 that receive the threaded ends of the bolts 21. The housing 15 also includes a central opening or cavity 62 arranged along the longitudinal axis 17. The central opening 62 is stepped to receive suitable bearings 63-65 for supporting the output assembly 16. The central opening also carries suitable seals 66 and 67 for precluding egress of hydraulic fluid and ingress of dirt and other foreign materials into the central opening 62. An external groove on the external surface of the housing 15 carries a seal 68 that seals against a surface of the hydraulic pump (not shown in FIG. 1 but shown schematically in FIG. 8) to which the hydraulic motor 10 is bolted as described above. The housing 15 is machined from a steel casting.

As best shown in FIG. 1, the output assembly 16 includes the drive link 31 and an output shaft 72. The drive link 31 includes a commutator drive extension 73 that is received in a corresponding central opening in the commutator plate 22 to drive the commutator plate 22 in a clockwise orbital path relative to the manifold 11. The drive link 31 also includes splines 74 near its rightward end that mesh with splines 75 on the output shaft 72. The drive link 31 is driven by engagement of the splines 46 of the rotor 37 with splines 76 of the drive link 31. The central region of the drive link 31 is supported in the central opening 53 of the wear plate 14 to permit rotational and rocking movement of the drive link 31 relative to the wear plate 14. The splines 76 and 74 of the drive link 31 transmit torque from the rotor 37 through the drive link 31 to the output shaft 72. In this manner, energy from the pressurized fluid that drives the rotor 37 is transmitted to the output shaft 72. A key slot 77 on the outer surface of the output shaft 72 connects the output shaft 72 to the device that is to be driven by the motor 10 in a well know manner. The drive link 31 and the output shaft 72 are of machined steel.

Generally circular longitudinally facing grooves 78 extend around the end faces of the end plate 11 and manifold 12 to receive generally circular seals to prevent leakage between the end plate 11 and the manifold 12 and between the manifold 12 and the drive assembly 13 in a well known manner.

Figure 7:
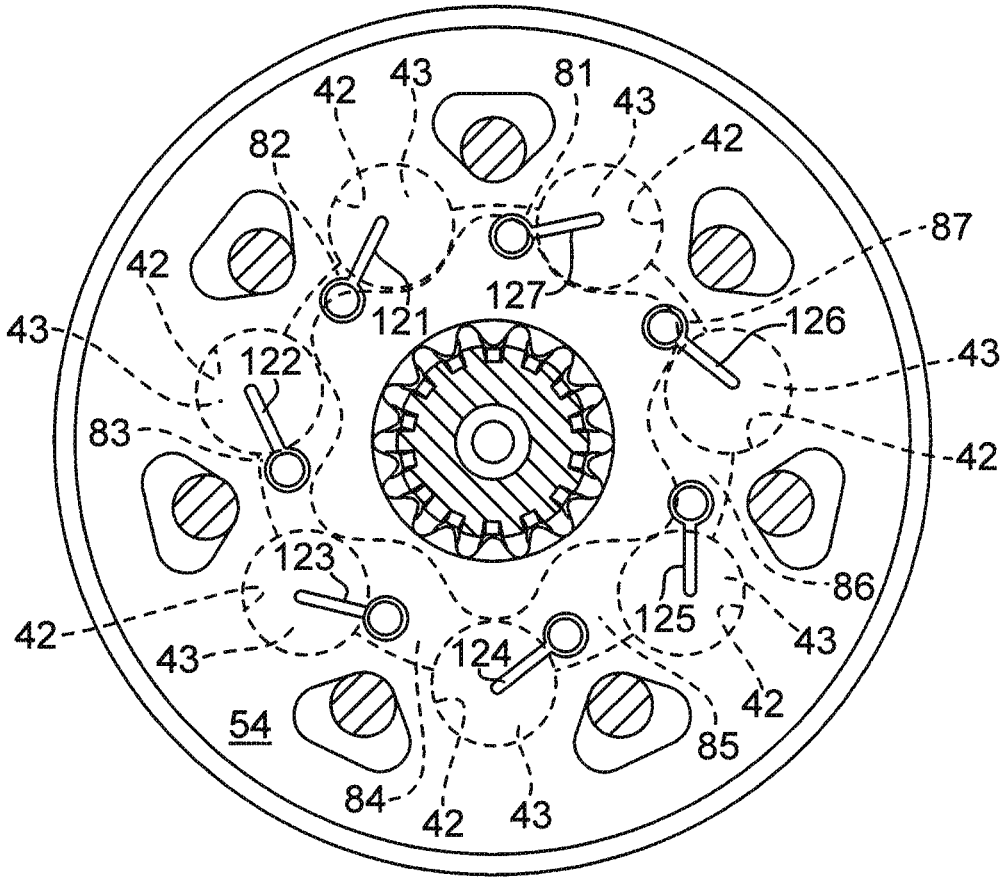
FIG. 7 is a view identical to FIG. 4, but with the addition of a dotted line outline of the stator and rotor to illustrate the alignment and relative positions of the stator, rotor, fluid chambers, and second set of anti-cogging passages in the hydraulic motor of FIG. 1.

Referring now to FIGS. 6 and 7, FIG. 6 is the same view as FIG. 2, except that the outline of the stator 36 and rotor 37 are projected onto the view of FIG. 2 in dotted lines in FIG. 6 to illustrate the alignment of the stator 36 and rotor 37 with fluid passages described below in the manifold plate 28. FIG. 7 is the same view as FIG. 4, except that the outline of the stator 36 and rotor 37 are projected onto the view of FIG. 4 in dotted lines in FIG. 7 to illustrate the alignment of the stator 36 and rotor 37 with fluid passages described below in the wear plate 14.

Referring to FIGS. 6 and 7 together with FIG. 1, the inner gear set of seven teeth 43 and the external gear set of six teeth 47 effectively engage and cooperatively define seven fluid chambers 81-87 in the drive assembly 13. The chambers 81-87 are separated from one another by effective moving contact between the external gears 47 and the internal gears 43. As the rotor 37 rotates relative to the stator 36, the chambers 81-87 each expand and contract. In the preferred embodiment there is an interference fit between the teeth 43 and 47. Alternatively there may be a slight clearance while still achieving only minimal leakage and providing effective moving contact.

The rotary and orbital movement of the rotor 37 is caused by pressurized hydraulic fluid that is directed by the commutator 22 from the inlet chamber 18 to the passages 29*a*, 29*b*, 29*c* and 29*d*. As illustrated in FIG. 6, these passages are aligned with fluid chambers 81, 82, 83 and 84, respectively, of the drive assembly 13. The pressurized fluid causes the chambers 81, 82, 83 and 84 to expand, and this rotates the rotor 37 in the counterclockwise direction. In a similar manner, when the components of the motor 10 are in the positions illustrated in FIG. 6, lower pressure drain fluid from the chambers 85, 86 and 87 is directed by the commutator 22 from the passages 29*e*, 29*f* and 29*g* to the outlet chamber 19. This allows the chambers 85, 86 and 87 to contract.

Figure 8:
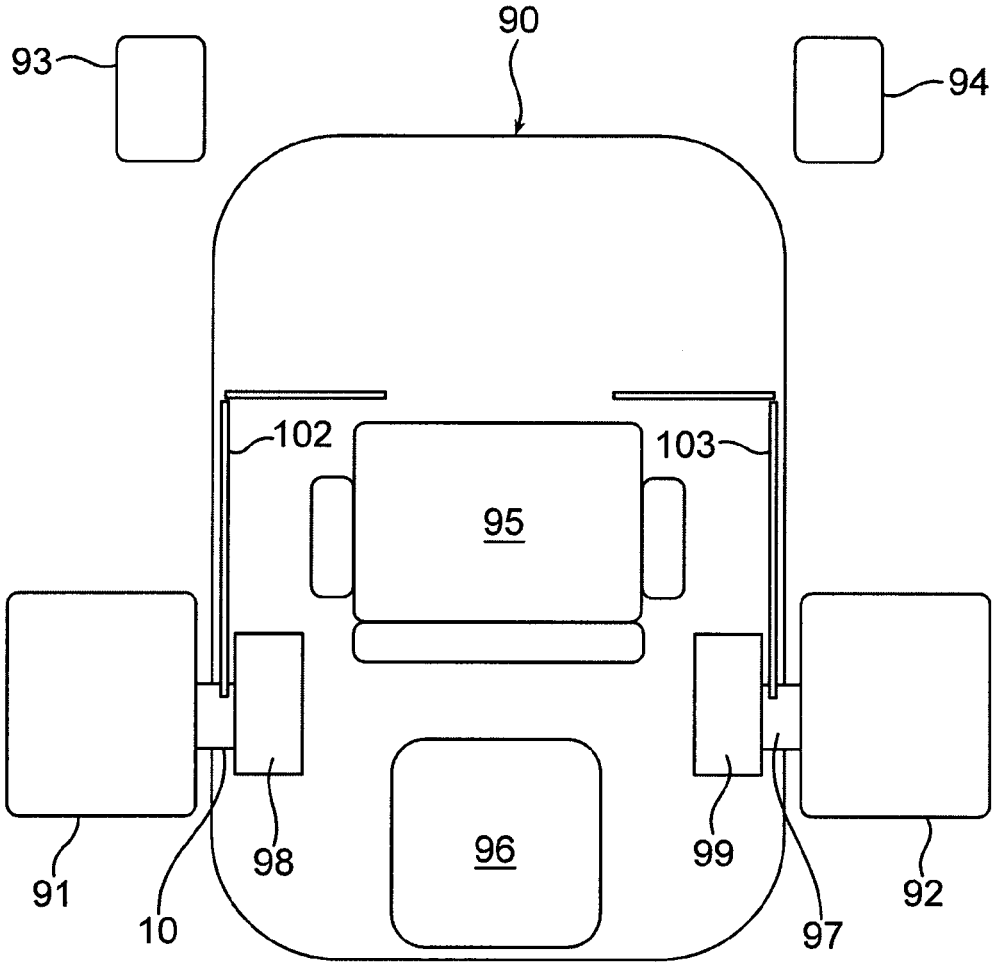
FIG. 8 is a schematic representation of a hydraulic circuit and self propelled vehicle according to the principles of this invention.

As shown in FIG. 8, the hydraulic motor 10 may be used on a lawn mower 90 of the type that is called a zero turn mower. The mower 90 includes a left drive wheel 91 and a right drive wheel 92, both located at the rear of the mower 90, and free spinning wheels 93 and 94 located at the front of the mower 90. A seat 95 is provided for the human operator that rides and controls the mower 90, and a drive engine 96, which may be gasoline or diesel or any other convenient type of motor or engine, is located behind the driver seat 95 to power the mower blades and the hydraulic pumps described below. The output shaft 72 of the hydraulic motor 10 is mechanically connected to the left drive wheel 91 of the mower 90. A motor 97 that is identical to the mower 10 except that it is arranged to have an opposite forward direction is mechanically connected to the right drive wheel 92. A source or sources of pressurized hydraulic fluid, which in the preferred embodiment includes two variable displacement hydraulic pumps 98 and 99 but which can be any other source of pressurized fluid, are bolted to and hydraulically connected to supply pressurized hydraulic fluid to and receive return hydraulic fluid from, the motors 10 and 97, respectively. The operator of the mower 90, in a well known manner, manually moves control levers 102 and 103 to control the displacement and pressure and direction of the fluid pressure output of each of the pumps 98 and 99. This controls the speed and torque and direction of each of the motors 10 and 97, to control the speed and torque and direction of the drive wheels 91 and 92.

When the hydraulic motor 10 and the mower 90 are used at normal relatively higher operating speeds to cut a maximum area of grass in a given amount of time, any cogging of the motor 10 should not be objectionable and will most likely not even be perceptible to the operator of the mower 90. However, if the motor 10 exhibits cogging characteristics that are objectionable, particular at the operating conditions discussed above in the Background of The Invention when the motor 10 is used at relatively low speeds and relatively high pressures in a hydraulic circuit and equipment as discussed above and as illustrated in FIG. 8, the present invention provides a structure and method that reduces the amount of hydraulic motor cogging.

The hydraulic motor 10 provides an arrangement of an anti-cogging passage, and preferably a plurality of anti-cogging passages in a geometric configuration, that measurably reduce cogging of the motor 10 in comparison with an otherwise identical hydraulic motor that does not include the anti-cogging structure to reduce or eliminate objectionable cogging.

Referring now to FIGS. 1, 2, 3 and 6, a first set of anti-cogging passages 111-117 is provided in the lateral or radial end face 32 of the manifold plate 28 of the manifold 12. Each of the anti-cogging passages 111-117 is in the shape of a shallow and narrow groove in the end face 32 that extends from one of the fluid chambers 81-87, respectively, to one lateral or radial end face 49 of one of the rollers 43. In the embodiment disclosed herein, the groove dimensions are sufficiently small as to preclude any substantial leakage from the chambers 81-87 through the anti-cogging passage 111-117 but are sufficiently large as to substantially communicate the pressure in the chambers 81-87 to the radial end faces 49 of the rollers 43 in a substantially open or unrestricted pressure communication. The length of each anti-cogging passage 111-117 is at least about ¼ the diameter of its adjacent roller 43 and is preferably at least about ½ the diameter of its adjacent roller 43. The nominal cross sectional area of each anti-cogging passage 111-117 measured in a plane perpendicular to its length is in the range of about 0.1 to 10 square millimeters and is preferably about 0.6 square millimeters. The surface area of each anti-cogging passage 111-117 adjacent the end face 49 of its adjacent roller 43 is in the range of about 1 to about 100 square millimeters and is preferably about 20 square millimeters. The anti-cogging passages 111-117 are not shown by lines in FIG. 1, due to the relatively small size of the passages.

In the embodiment disclosed herein, each anti-cogging passage 111-117 extends from a location adjacent the intersection of a manifold passage 29*a*-29*g* with its adjacent fluid chamber 81-87, respectively. The fluid pressure in each fluid chamber 81-87 is substantially the same as the pressure in the manifold passage 29*a*-29*g* adjacent such fluid chamber, so that as used herein the term fluid chamber with reference to the chambers 81-87 may include that portion of the adjacent passage 29 that is at substantially the same pressure level as the pressure level in such chamber. While the anti-cogging passages 111-117 in the preferred embodiment are disposed in the radial end face 32 of the manifold plate 28 of the manifold 12 adjacent the stator 36 and rotor 37, the anti-cogging passages may alternatively be disposed at another location or locations that substantially communicate the pressure level in the fluid chambers 81-87 to the end faces 49 of the rollers 43 without causing substantial leakage.

Referring now to FIGS. 1, 4, 5 and 7, a second set of anti-cogging passages 121-127 is provided in the lateral or radial end face 54 of the wear plate 14. Each of the anti-cogging passages 121-127 is a shallow groove in the end face 54 of the wear plate 14 and is of a size and shape substantially the same as the size and shape of each of the anti-cogging passages 111-117 described above. The end face 54 of the wear plate 14 also includes a supply passage 128 (shown in cross section in FIG. 5). The supply passages 128 are each sufficiently large to communicate substantially the full unrestricted fluid pressure from each fluid chamber 81-87 to its adjacent anti-cogging passage 121-127, respectively, at all times. While the second set of anti-cogging passages 121-127 in the preferred embodiment are disposed in the radial end face 54 of the wear plate 14 adjacent the stator 36 and rotor 37, the second set of anti-cogging passages may alternatively be disposed at another location or locations that substantially communicate the pressure level in the fluid chambers 81-87 to the end faces 50 of the rollers 43.

For both the first set of anti-cogging passages 111-117 and the second set of anti-cogging passages 121-127, the geometric shape and size of each passage in the preferred embodiment (a) communicates with the fluid pressure level in the higher pressure one of the fluid chambers adjacent each roller, (b) provides a passage to its adjacent roller end face that is sufficiently small to prevent substantial leakage yet sufficiently large to substantially communicate that pressure level to its adjacent roller end face, and (c) provides this pressure communication to opposite end faces of each roller 43 at substantially the same time during rotation of the motor 10.

As further shown in FIGS. 1-7, the anti-cogging passages 111-117 each extend from and communicate the fluid pressure from the fluid pressure chamber 81-87 that is on the higher pressure side of each roller 43 to one end face 49 of each roller 43 when the motor 10 is operating in the forward direction. Similarly, the anti-cogging passages 121-127 each extend from and communicate the fluid pressure from the fluid pressure chamber 81-87 that is on the higher pressure side of each roller 43 to the other end face 50 of each roller 43 when the motor 10 is operating in the forward direction. As discussed above, the fluid pressure chambers on each side of each roller 43 are separated by the effective line contact between the external teeth 47 of the rotor 37 with the rollers 43.

When the motor 10 is operated in the reverse direction, the anti-cogging passages 111-117 and 121-127 communicate the fluid pressure from the fluid pressure chamber 81-87 that is on the lower pressure side of each roller 43 to one end face of each roller 43. The anti-cogging passages 111-117 may not produce the same amount of anti-cogging benefit when the motor 10 is operated in the reverse direction as when the motor 10 is operated in the forward direction. It is believed that this may be because a lower pressure level is communicated to the end faces of the rollers 43 when the motor 10 is operated in the reverse direction. This may not be a particular concern, because in most hydraulic circuits and equipment in which the motor 10 is installed, the motor is usually or always operated in the forward direction and cogging in the reverse direction is not as significant a concern as when the motor is operated in the forward direction.

A presently preferred embodiment of the invention is shown and described in detail above. The invention is not, however, limited to this specific embodiment. Various changes and modifications can be made to this invention without departing from its teachings, and the scope of this invention is defined by the claims set out below.

What is claimed is:

1. A hydraulic motor comprising:

a drive assembly including a stator and a rotor, each of said stator and said rotor having a longitudinal axis;

at least one of said stator and said rotor including a plurality of rollers, each of said rollers having a generally circular outer surface and an end face, said circular surfaces of said rollers defining a first set of teeth that engage a second set of teeth on the other of said stator and said rotor, said first and second sets of teeth defining expanding and contracting fluid chambers;

and an anti-cogging fluid passage extending between and establishing fluid pressure communication between at least one of said fluid chambers and at least one of said roller end faces.

2. A hydraulic motor as set forth in claim 1, wherein said stator includes a plurality of roller cavities, each of said rollers is disposed in one of said roller cavities and provides said first set of teeth, and said rotor has a surface that defines said second set of teeth.

3. A hydraulic motor as set forth in claim 1, wherein said longitudinal axes of said rotor and said stator are parallel and spaced apart.

4. A hydraulic motor as set forth in claim 1, including a plurality of anti-cogging fluid passages, and each of said plurality of anti-cogging fluid passages extends between and establishes fluid pressure communication between one of said fluid chambers and one of said roller end faces.

5. A hydraulic motor as set forth in claim 4, wherein said anti-cogging fluid passages, said rollers and said chambers are equal in number.

6. A hydraulic motor as set forth in claim 1, including a member adjacent said rotor and said stator, said anti-cogging passage is located at least partially within said member, said member and said rotor and said stator each include a radial end face, all of said end faces lie in a plane, and all of said planes are parallel.

7. A hydraulic motor as set forth in claim 1, wherein each of said rollers includes another end face, and another anti-cogging fluid passage extends between and establishes fluid pressure communication between one of said fluid chambers and said other of said roller end faces.

8. A hydraulic motor as set forth in claim 7, including a first plurality of fluid passages each extending between and establishing fluid pressure communication between one of said fluid chambers and one of said first mentioned roller end faces, a second plurality of fluid passages each extending between and establishing fluid pressure communication between one of said fluid chambers and one of said other roller end faces.

9. A hydraulic motor as set forth in claim 8, wherein said first mentioned plurality of fluid passages and said second mentioned plurality of fluid passages are each equal in number to said rollers.

10. A hydraulic motor as set forth in claim 9, wherein said first set of teeth and said second set of teeth effectively engage along a contact line, said contact lines separate each of said fluid chambers from one another, and the fluid chamber on one side of each of said contact lines is at a higher pressure level than on the other side of said contact line.

11. A hydraulic motor as set forth in claim 10, wherein each of said first plurality of fluid passages establishes substantially open fluid pressure communication between the higher pressure level fluid chamber adjacent each said contact line and the first mentioned end face of the said roller that defines said contact line, and each of said second plurality of fluid passages establishes fluid pressure communication between the higher pressure level fluid chamber adjacent each said contact line and said other end face of said roller that defines said contact line.

12. A hydraulic motor as set forth in claim 10, including a first member, said first member includes a surface adjacent said rotor and said stator and said rollers, a second member, said second member includes another surface adjacent said rotor and said stator and said rollers, said anti-cogging fluid passage is located at least partially within said first member, and said another anti-cogging fluid passage is located at least partially within said second member.

13. A hydraulic motor as set forth in claim 12, wherein said stator and said rotor and said first member each include a radial end face, said radial end faces of said stator and said rotor and said first member and said first mentioned end face of said rollers are all parallel, said stator and said rotor and said second member each include another radial end face, and said other radial end faces of said stator and said rotor and said second member and said other end face of said rollers are all parallel.

14. A hydraulic motor as set forth in claim 13, wherein said first plurality of passages is at least partially defined by said radial end face of said first member, and said second plurality of passages is at least partially defined by said radial end face of said second member.

15. A hydraulic motor as set forth in claim 14, wherein said first plurality of passages are defined by grooves in said radial end face of said first member, and said second plurality of passages are defined by grooves in said radial end face of said second member.

16. A hydraulic motor comprising:

a drive assembly, a manifold, and a wear plate;

said drive assembly including a stator and a rotor, each of said stator and said rotor having a longitudinal axis, the longitudinal axis of said stator being parallel to and spaced from the longitudinal axis of said rotor, each of said stator and said rotor having first and second end faces;

at least one of said stator and said rotor including a plurality of rollers, each of said rollers having a longitudinal axis substantially perpendicular to the longitudinal axes of said stator and said rotor, each of said rollers having a generally circular outer surface and having first and second end faces, said circular surfaces of said rollers defining a first set of teeth that engage a second set of teeth on the other of said stator and said rotor, said first and second set of teeth defining expanding and contracting fluid chambers;

said manifold including a surface adjacent to said first end faces of said stator and said rotor, a plurality of working fluid passages extending through said manifold surface, each of said fluid chambers being in fluid pressure communication with at least one of said manifold fluid passages;

said wear plate including a surface adjacent to said second end faces of said stator and said rotor;

and an anti-cogging fluid passage in at least one of said wear plate and said manifold, said anti-cogging passage extending between and establishing fluid pressure communication between one of said fluid chambers and one of said first and second end faces of said rollers.

17. A hydraulic motor as set forth in claim 16, wherein each of said manifold and said wear plate has at least one said anti-clogging fluid passage.

18. A hydraulic motor as set forth in claim 17, wherein said anti-cogging fluid passages in each of said manifold and said wear plate and said rollers are equal in number, each of said anti-cogging fluid passages in said manifold establishes fluid pressure communication between one end face of one of said rollers and a fluid chamber adjacent said roller, and each of said anti-cogging fluid passages in said wear plate establishes fluid pressure communication between the other end face of one of said rollers and a fluid chamber adjacent said roller.

19. A hydraulic motor as set forth in claim 18, wherein said anti-cogging fluid passages in said manifold and in said wear plate that are in fluid communication with the first and second end faces of each respective one of said rollers are in fluid pressure communication with the same one of said fluid chambers.

20. A hydraulic motor as defined in claim 19, wherein each of said anti-cogging passages in said wear plate is in fluid communication with said one end face of one and only one of said rollers, and each of said anti-cogging passages in said manifold is in fluid communication with said other end face of one and only one of said rollers.

21. A hydraulic motor as set forth in claim 16, wherein said motor is assembled in a hydraulic circuit, said hydraulic circuit includes a variable displacement hydraulic pump, said pump includes an output control mechanism for being manually held by and operated by human operator input, said hydraulic pump is operated at a pressure level greater than 1,000 pounds per square inch, said hydraulic pump has a fluid pressure outlet hydraulically connected to said motor, and said motor is operated at less than five revolutions per minute.

22. A low speed high torque geroller hydraulic motor comprising:

a drive assembly, a manifold, a wear plate and a housing; said drive assembly including a stator and a rotor, each of said stator and said rotor having a longitudinal axis, said longitudinal axis of said stator being parallel to and spaced from said longitudinal axis of said rotor, each of said stator and said rotor having first and second radial end faces, said first radial end faces being coplanar in a first plane that is perpendicular to said longitudinal axes, said second radial end faces being coplanar in a second plane that is parallel to said first plane;

said stator including a plurality of rollers, each of said rollers having a longitudinal axis perpendicular to the longitudinal axes of said stator and said roller, each of said rollers having a generally circular outer surface extending in the longitudinal direction of the roller and having first and second radial end faces, said first and second radial end faces of said rollers being coplanar with said first and second planes respectively of said radial end faces of said stator and said roller, said circular surfaces of said rollers defining a first set of teeth that effectively engage a second set of teeth on the other of said stator and said rotor in a moving longitudinally extending contact line upon relative rotational movement of said stator and said rotor, radially adjacent teeth of said first and second set of teeth defining expanding and contracting fluid chambers between circumferentially adjacent moving contact lines, and the fluid chamber on one side of said contact line being at a higher fluid pressure level relative to the fluid chamber on the other side of said contact line during operation of said motor;

said manifold including a radial end face longitudinally immediately adjacent to and parallel with said first radial end faces of said stator and said rotor, a plurality of fluid passages extending longitudinally through said manifold end face, each of said fluid chambers being in fluid pressure communication with at least one of said manifold end face fluid passages;

said wear plate including a radial end face longitudinally immediately adjacent to and parallel with said second radial end faces of said stator and said rotor;

said housing including an inner cavity, a drive link disposed in said inner cavity and mechanically connected to one of said stator and said rotor;

and a plurality of anti-cogging fluid passages in said wear plate radial end face and in said manifold radial end face, said anti-cogging passages in said manifold radial end face establishing fluid communication between said fluid chamber on one side of each contact line and the first radial end face of the respective roller that engages a radially adjacent tooth to define said contact line, and said anti-cogging passages in said wear plate radial end face establishing fluid communication between said fluid chamber on said one side of said contact line and the second radial end face of said respective roller.

23. A hydraulic motor as set forth in claim 22, wherein the number of fluid chambers, the number of rollers, the number of anti-cogging passages in said wear plate, and the number of anti-cogging passages in said manifold are all equal.

24. A hydraulic motor as set forth in claim 23, wherein said anti-cogging passages in said wear plate and said manifold that are in communication with said first and second end faces of each of said rollers are open to and closed from fluid communication with the same one of said fluid chambers at the same time.

* * * * *